US008387712B2

(12) United States Patent
Flynn

(10) Patent No.: US 8,387,712 B2
(45) Date of Patent: Mar. 5, 2013

(54) FIRE SPRINKLER WITH BALL-TYPE CUTOFF VALVE AND TAMPER-RESISTANT FEATURES

(76) Inventor: Matt Flynn, Raleigh, NC (US)

( * ) Notice: Subject to any disclaimer, the term of this patent is extended or adjusted under 35 U.S.C. 154(b) by 339 days.

(21) Appl. No.: 12/962,340

(22) Filed: Dec. 7, 2010

(65) Prior Publication Data

US 2011/0120737 A1 May 26, 2011

Related U.S. Application Data

(63) Continuation-in-part of application No. 12/359,880, filed on Jan. 26, 2009, now Pat. No. 7,845,425.

(51) Int. Cl.
*A62C 37/08* (2006.01)

(52) U.S. Cl. ..... 169/90; 169/41

(58) Field of Classification Search ..... 169/37, 169/90, 40, 41, 19, 33; 239/569, 580, 582.1
See application file for complete search history.

(56) References Cited

U.S. PATENT DOCUMENTS

| | | | | |
|---|---|---|---|---|
| 2,697,008 | A | 12/1954 | Rowley | |
| 3,757,866 | A * | 9/1973 | Mears et al. | 169/37 |
| 4,073,438 | A | 2/1978 | Meyer | |
| 4,638,866 | A | 1/1987 | Capasso et al. | |
| 4,676,320 | A * | 6/1987 | Capasso | 169/90 |
| 4,830,117 | A | 5/1989 | Capasso | |
| 4,923,013 | A | 5/1990 | De Gennaro | |
| 6,575,252 | B2 | 6/2003 | Reed | |
| 6,648,077 | B2 | 11/2003 | Hoffman | |
| 6,854,668 | B2 | 2/2005 | Wancho et al. | |
| 6,976,543 | B1 | 12/2005 | Fischer | |
| 7,275,604 | B1 | 10/2007 | Wall | |
| 7,422,072 | B2 | 9/2008 | Dade | |
| 2002/0139056 | A1 | 10/2002 | Finnell | |
| 2003/0010509 | A1 | 1/2003 | Hoffman | |
| 2004/0163828 | A1 | 8/2004 | Silverstein | |
| 2005/0121206 | A1 | 6/2005 | Dolan | |
| 2006/0042803 | A1 | 3/2006 | Gallaher | |
| 2007/0215362 | A1 * | 9/2007 | Rodgers | 169/46 |
| 2007/0221388 | A1 | 9/2007 | Johnson | |
| 2007/0256843 | A1 | 11/2007 | Pahila | |
| 2007/0267202 | A1 | 11/2007 | Mariller | |

* cited by examiner

*Primary Examiner* — Davis Hwu

(74) *Attorney, Agent, or Firm* — Todd L. Juneau

(57) ABSTRACT

The present invention relates to a fire sprinkler head that once activated can be shut off via a built-in ball-type cutoff valve without requiring the flow of fire retardant in the feeding pipe to be cut off.

19 Claims, 15 Drawing Sheets

FIRE SPRINKLER WITH BALL-TYPE CUTOFF VALVE AND TAMPER-RESISTANT FEATURES

CROSS REFERENCE TO RELATED APPLICATIONS

This application is a Continuation-in-Part of application Ser. No. 12/359,880, filed Jan. 26, 2009 now U.S. Pat. No. 7,845,425, claiming priority under 35 USC 120, the entire contents of which are incorporate herein by reference in its entirety.

STATEMENT REGARDING FEDERALLY SPONSORED RESEARCH OR DEVELOPMENT

No federal government funds were used in researching or developing this invention.

NAMES OF PARTIES TO A JOINT RESEARCH AGREEMENT

Not applicable.

BACKGROUND

1. Field of the Invention

The present invention relates to a fire sprinkler head that once activated can be shut off via a built-in ball-style cutoff valve without requiring the flow of fire retardant in the feeding pipe to be cut off.

2. Background of the Invention

When commercial and residential fire sprinklers are activated by heat, fire retardant flows freely through the sprinkler. Usually that fire retardant is water. Once the fire or fire risk has been suppressed, continued retardant flow causes considerable damage. In many cases the damage from water or other retardant grossly exceeds the damage caused by fire. It would be beneficial for firefighters and building support personnel to be able to shut off an individual fire sprinkler quickly. The current primary method for cutting off the flow of water or other retardant is to shut the retardant off at the source for the sprinkler system. This is time-consuming, as finding the riser room and then the correct shutoff valve can take many minutes. It is also dangerous, as the entire sprinkler system or subsystem is disabled until the fire sprinkler is repaired or replaced and water pressure is reestablished.

In certain buildings with fire prevention systems, such as college dormitories or commercial buildings, occupants or invitees might be tempted to tamper with sprinklers featuring a manually operated valve. For any sprinkler system including such a feature, it therefore becomes important to provide a tamper-resistant operation feature whereby only authorized personnel are given access to the valve.

The inclusion of a manually operated cutoff valve in a fire sprinkler has the potential to alter or enlarge the size of the sprinkler housing and/or assembly, making such housing or assembly difficult or impossible to mount within existing fire prevention systems and supply pipes. Such a feature also has the potential to unreasonably increase the cost of manufacture and installation of each such sprinkler. Inclusion of a cutoff valve within a standard sprinkler assembly and housing would be beneficial to combat such incompatibility and to keep costs in line with standard sprinklers.

Capasso et al. U.S. Pat. No. 4,638,866 discloses an apparatus for stopping the flow of water through the opening in a fire sprinkler head after the failure of an originally installed triggering device, which apparatus thereafter serves as a substitute triggering device. The apparatus is provided with a meltable body portion having a first bore formed therein with a shoulder formed at one end of the first bore and a second bore formed generally transverse to and in contact with the first bore at the shoulder end of the first bore, a spring positioned in the first bore, a piston positioned within the spring and having a slot at one end which is alignable with the second bore and a pin inserted through the second bore and engaging the piston slot. Thus, after placement in a sprinkler head, transverse movement of the pin results in the release of the piston which is moved by the spring into the sprinkler head opening, stopping the flow of water.

Capasso, U.S. Pat. No. 4,830,117 discloses a thermally responsive device for terminating the discharge of fire-extinguishing fluid from an activated sprinkler head of the pendent and sidewall type. The device includes a recessed seat which, when impressed onto an activated sprinkler head, returns the shut-off valve to the water emitting conduit to obturate fluid flow. The device is secured by a frictional locking means which allows it to remain in place as a guard against inadvertent discharge.

DeGennaro, U.S. Pat. No. 4,923,013 discloses an automatic shut-off valve arrangement for a fire sprinkler system includes a set of auxiliary pipe fittings interconnected between the water distribution pipes and the sprinkler heads. Each fitting houses a multi-vane paddle wheel rotatably mounted under an eccentric valve opening normally unobstructed by a movable valve member, and the paddle wheel axle is connected by a gear train to an actuator for the valve member. When water flows from the distribution pipe through the fitting and exits therefrom via the sprinkler head to douse a fire, the paddle wheel rotates rapidly and drives the actuator via the gear train so that the valve member is shifted to close the valve opening and interrupt the flow of water therethrough after a prescribed time interval, thereby minimizing the risk of water damage to the protected premises.

Reed, U.S. Pat. No. 6,575,252 discloses a tool for deactivating a sprinkler head. The tool includes a housing, a first arm supported by the housing and a second arm supported for movement relative to the first arm. A first engagement surface is supported by the first arm and a second engagement surface is supported by the second arm. The first and second engagement surfaces are adapted for positioning intermediate a valve and a receiving support of the sprinkler head. A biasing member is operably connected to the second arm for urging the second engagement surface away from the first engagement surface. A handle is supported by the second arm and is moveable relative to the housing.

Wancho et al., U.S. Pat. No. 6,854,668 discloses a sprinkler that discharges a column of water downwardly onto a deflector that has a plurality of peripheral tines with a respective non-radial tapered notch separating each adjacent pair of tines. Opposed cutouts with tabs in the central portion of the deflector combine with the notches and with depressed peripheral tabs to produce a predetermined spray pattern.

Fischer, U.S. Pat. No. 6,976,543 discloses a low pressure, extended coverage, fire protection sprinkler, i.e. of the upright type, suitable for use in protection of extra hazard and high piled storage occupancies, in accordance with the 1999 Edition of NFPA 13, that has a body with an internal passageway extending between an inlet end and an opposite outlet end, and a deflector mounted to the body by at least one support arm and disposed in alignment with the axis and generally spaced from the outlet end of the internal passageway. The sprinkler has a predetermined K-factor, i.e. of greater than about 16.0. The sprinkler is configured and arranged to deflect flow of water generally radially outwardly and downwardly of the sprinkler in a predetermined spray pattern. Preferably, the predetermined spray pattern has a generally polygonal shape, e.g., a rectangular shape, when viewed at a predetermined distance below the deflector.

Dade, U.S. Pat. No. 7,422,072 discloses a sprinkler wedge designed for inhibiting water discharge from an open or activated sprinkler head. The sprinkler wedge generally comprises a main body having proximal and distal ends, a handle assembly connected toward the proximal end for easy grasping by a human hand, and a forked tip toward the distal end. The sprinkler wedge is designed for improved single-handed insertion into the water stream of an activated sprinkler head.

Flynn, U.S. patent application Ser. No. 12/359,880, Pub. No. 20100186973, discloses a sprinkler with a built-in cone plug-style cutoff valve manually operated from a screw head disposed on the underside of the sprinkler, within the center of the deflector shield. By turning the screw head using a standard or modified screwdriver, the operator moves the cone plug along the central axis of the sprinkler, from an open position into a closed position wherein the cone engages with a seal and blocks fire retardant from exiting the sprinkler.

BRIEF SUMMARY OF THE INVENTION

The present invention builds a reusable cutoff valve into a fire sprinkler head. Once the sprinkler activates and the fire is suppressed, the cutoff valve can be used to completely and reliably shut off water flow. Leakage and closure failure are eliminated. Further, the water in the supply pipe does not have to be cut off. Other fire sprinkler heads are not affected, and the rest of the fire suppression system is not disabled. This is particularly important for densely populated living spaces such as dormitories and hotels, where loss of life can be considerable if a second fire breaks out while the system is down.

Embodiments of the present invention may include one or more of the following features.

In a preferred embodiment, there is provided a fire sprinkler with a built-in cutoff valve, comprising: a sprinkler housing comprising an externally threaded round sprinkler nozzle disposed along a central axis and allowing fire retardant to flow into said housing, said sprinkler nozzle having a distal end for connecting to a supply pipe and a proximal end overlapping a ball valve capable of being manually set to allow or disallow the flow of retardant, such ball valve comprised of a rotatable ball set between an upper ball seal and a lower ball seal and connected to a closure stem, such upper ball seal disposed within the proximal end of the sprinkler nozzle and such lower ball seal disposed within the upper annulus of a lower body unit comprised of such upper annulus attached to a pair of support arms, wherein each support arm extends from the upper annulus and terminates at a lower annulus that is disposed along the central axis, such lower body unit further comprising an activation plug disposed within each of the upper annulus, lower ball seal and the ball itself, said activation plug braced against the proximal end of a heat-sensitive rod disposed along the central axis between said support arms, the distal end of such heat-sensitive rod seated in the proximal end of a bracing point, the distal end of such bracing point attached to the center of a circular deflector shield, and said support annulus attached to the center of said deflector shield.

In another embodiment, the fire sprinkler described herein, wherein an aperture is drilled into the side of said sprinkler housing through which a closure stem for manually engaging or disengaging the ball valve may be fitted, such closure stem comprising a socket comprised of a proximate end allowing engagement with a wrench or other device capable of turning such socket, and a distal end allowing engagement with a stud, further comprising a hollow compression nut comprising a proximate end fitted flush against the exterior of the housing around said aperture and a smaller circular distal end fitted flush into the aperture, such distal end contacting an inner seal ring of the same gauge and circumference as the distal end of the compression nut, wherein the distal end of the socket extends through the interior of said compression seal, where said distal end of the socket engages the proximate end of a stud disposed within the compression seal and inner seal and compression seal, further comprising wherein the distal end of such stud engages an indentation in the side of the ball, allowing an operator to rotatably open and close the ball valve.

In another preferred embodiment, the fire sprinkler described herein, wherein the externally threaded sprinkler nozzle is fitted for standard fire sprinkler fitting sizes.

In another embodiment, the fire sprinkler described herein, wherein the sprinkler contains a wrench fitting to allow easier connection and disconnection from a sprinkler supply.

In another embodiment, the fire sprinkler described herein, wherein the sprinkler contains a standard sealed fire sprinkler activation plug that stops the flow of the fire retardant from the sprinkler supply pipe through the sprinkler.

In another embodiment, the fire sprinkler described herein, wherein the heat-sensitive rod is a frangible support rod that (1) holds the plug in place, (2) is thermodynamically responsive to at least one of heat, smoke, infrared radiation and ultraviolet radiation emitted by a heat source, and (3) deforms or dissolves when heated to its tolerance temperature.

In another embodiment, the fire sprinkler described herein, wherein the deflector shield disperses water or other fire retardant in a reasonably uniform shower pattern to create more effective fire suppression.

In another embodiment, the fire sprinkler described herein, wherein the sprinkler is installed as a pendent sprinkler below the supply pipe.

In another embodiment, the fire sprinkler described herein, wherein the sprinkler assembly is of a sufficiently short length to allow the sprinkler to fit into a standard sprinkler head recession space.

In another embodiment, the fire sprinkler described herein, wherein the sprinkler is installed as one of a vertical sprinkler above the supply pipe, a lateral sprinkler, or any other angle to the supply pipe necessitated by conditions.

In another embodiment, the fire sprinkler described herein, wherein the ball valve forms water-tight or gas-tight seal against sprinkler supply pipe pressure.

In another embodiment, the fire sprinkler described herein, wherein the activation plug is inserted into the intra-ball aperture, thereby disallowing any attempt to manually close the ball valve prior to heat-induced activation of the sprinkler.

In another embodiment, the fire sprinkler described herein, wherein the ball valve is replaced with one of a gate valve, butterfly valve, annular valve, diaphragm valve, pinched valve, needle valve or other type of plumbing valve known in the art.

In another embodiment, the fire sprinkler described herein, wherein the socket is configured to allow for engagement and turning with a Phillips-head screwdriver, flat-head screwdriver, allen wrench, crescent wrench, pliers, hex wrench, or other standard hand tool.

In another embodiment, the fire sprinkler described herein, wherein the socket is permanently attached to a rod or handle allowing for engagement or disengagement of the ball valve without the use of any standard or nonstandard hand tool.

In another embodiment, the fire sprinkler described herein, wherein the socket has a custom tamper-resistant screw head access and is not accessible to any standard hand tool.

In another embodiment, the fire sprinkler described herein, wherein the socket has a standard head protected by a metal sheath, making the socket head inaccessible to any standard hand tool, for tamper resistance.

In another embodiment, the fire sprinkler described herein, wherein the socket is painted to facilitate ready identification of a closed or open configuration of the ball valve.

In another embodiment, the fire sprinkler described herein, wherein the socket is fluorescent and reflective red.

BRIEF DESCRIPTION OF THE DRAWINGS

Non-limiting engineering measurements are provided throughout the Figures.

DETAILED DESCRIPTION OF THE DRAWINGS

Figure 1B:
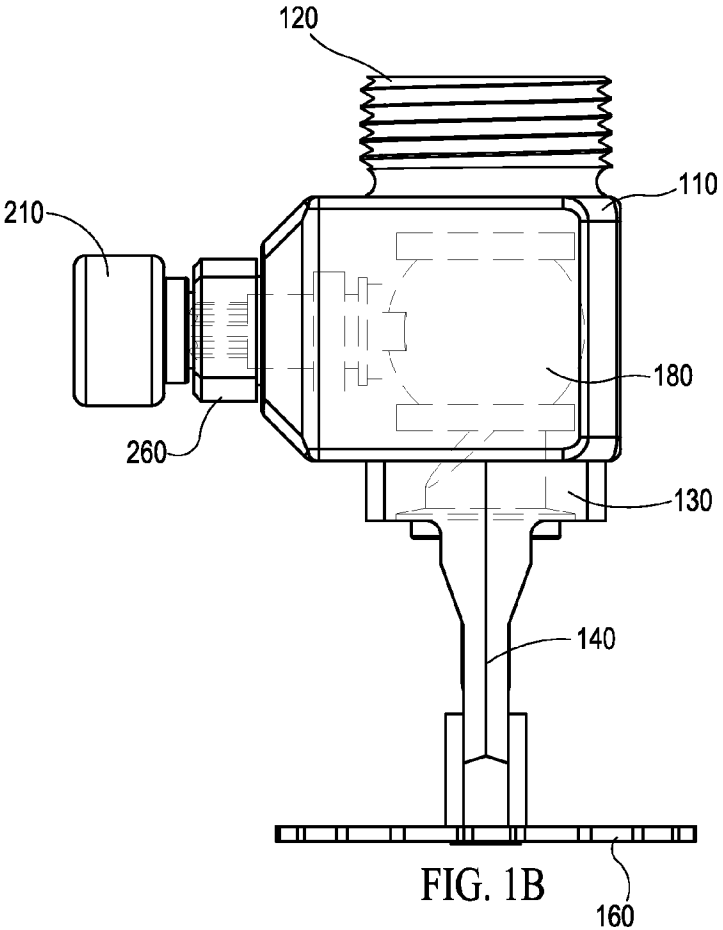
FIGS. 1*a-c* are a series of graphical representations of one embodiment of the fire sprinkler with the cutoff wrench engaged, viewed from a variety of perspectives.

This invention incorporates a cutoff valve into a fire sprinkler head. When a fire sprinkler activates, releasing retardant, a ball-style valve can be turned to close off the flow of retardant without affecting the function of other fire sprinklers and without shutting off retardant flow to the rest of the sprinkler system. Advantages of the present invention include that it is easy to open and close the secondary valve cutoff with one hand, and that the sprinkler cutoff valve can be reopened right away if the fire flares again. One does not need to go to the riser room or do anything other than rotate the valve to the off position.

In operation, any person, or an authorized person, in the case of a tamper-resistant feature, may approach an activated sprinkler after the need for activation has passed. Such person, either using a standard hand tool, a specialized hand tool, or a permanently attached handle, as appropriate, would then use the socket to rotate the closure stem by one-quarter turn, which will, in turn rotate the ball one-quarter turn, in so doing moving the intra-ball aperture from a parallel to a perpendicular position, thereby cutting off the flow of fire retardant through the sprinkler. In so doing, the operator will not impede either the activation of any other sprinkler, no would he/she stop or impede the flow of retardant through the supply pipe. Since the activation of the sprinkler dislodges the activation plug from the intra-ball aperture, prior to re-setting the sprinkler with a new heat-sensitive frangible rod, the sprinkler will be primed for re-activation simply by again turning the sprocket and closure stem another quarter turn. Thus, once de-activated, the sprinkler may be re-activated quickly if the situation so requires.

Since the ball valve is seated within the sprinkler head's threaded stem that fits into the feeding pipe, it also requires minimal modification to the standard sprinkler head design and minimal modification to the size and length of the housing, with standard fittings and sizes that allow the invention to be interchangeable with existing sprinkler heads, including sprinkler heads seated in standard-sized ceiling recesses. Allowing use of standard sized housings and fittings also makes the invention more affordable to make and install than sprinklers with cutoff functions demanding non-standard housings and fittings.

The cutoff valve is a ball-type valve in which the ball is attached to a closure stem emanating from the side of the sprinkler housing. After activation of the sprinkler, the ball valve can be rotated to a closed position by turning a closure stem using a fitted hand tool or permanently attached handle to reliably stop the flow of water. The sprinkler can then be rearmed and is reusable.

In another embodiment, another type of valve, including but not limited to a gate valve, butterfly valve, annular valve, diaphragm valve, pinched valve, needle valve or other type of valve known in the art, could be used for manual cutoff in lieu of a ball valve. Any such valve capable of being seated within the sprinkler housing and operable by a stem or other protrusion from the housing could be used similarly as a manual cutoff device.

Location of the closure stem on the side of the sprinkler housing allows access to the stem regardless of the position of the sprinkler in relation to the feeding pipe. Notably, the sprinkler may be seated above, below or beside a feeding pipe and still provide access to an operator for manual cutoff.

The heat-sensitive, frangible rod supports the activation plug, which plug is disposed within the ball valve prior to activation of the sprinkler. Since the plug is located within the hollow of the ball valve, the ball cannot be rotated prior to activation, rendering impossible any manual deactivation of the sprinkler prior to heat-induced activation.

An additional attribute of the invention is that, by using a ball valve, the risk of damage to the sprinkler by a manual operator using too much force in shutting the valve is highly unlikely. In the event an operator applies more force than required to close the valve, the valve will simply over-rotate and partially re-open, requiring slight readjustment.

The portion of the closure stem protruding from the housing is painted fluorescent reflective red or another readily visible color that is easily seen and will reflect a flashlight beam. When the valve is closed to deactivate the fire sprinkler, the indicator paint becomes visible, making deactivated fire sprinklers easy to identify.

Referring now to the invention, certain features or options are discussed below. They are summarized as follows:

1. Open port for flow of fire retardant from a supply pipe into the sprinkler head. This can be made in a variety of sizes depending on the flow needs of the sprinkler system.
2. Screw fitting for screwing the fire sprinkler head into the sprinkler pipe. These screw fittings come in several standardized sizes depending on flow requirements. They can easily be made any size.
3. Inferior to the screw fitting of #2 are thin flat plates that allow use of a wrench to install or remove the sprinkler head. They can be made for any size wrench large enough to fit around the flow port.
4. The distal aperture of the fire retardant port in the sprinkler head. This aperture contains the ball valve, which valve is in the open position but is sealed closed by a plug held in place by a heat sensitive rod. A wide range of plug sizes can be used to adapt to the intended flow volume of the fire sprinkler.
5. Plug to seal off fire retardant flow prior to activation. These plugs are sized to fit the ball valve, which is itself sized to fit the port. The size used depends on the flow requirements of the sprinkler system.
6. A thermodynamically responsive frangible rod responsive to at least one of heat, smoke, infrared radiation and ultraviolet radiation emitted by a heat source. It holds the plug labeled #5 in place prior to activation. It deforms or dissolves when heated beyond its tolerance temperature, which can vary with different fire sprinkler types and uses. Once it deforms or dissolves, the plug is pushed out by pressure in the sprinkler pipe. Fire retardant then flows. These rods are not reusable.
7. The bracing point for the heat-sensing rod.
8. Housing for the sprinkler that provides support for the deflector and the bracing point for the heat-sensing rod.
9. The bracing point for the heat-sensitive rod that holds the heat-sensing rod in place prior to activation. In FIG. 1 this bracing point also connects the housing to the deflector. Other fire sprinkler heads connect the deflector to the housing directly. Both methods have similar effects.
10. The deflector. This deflects the flow of fire retardant to provide relatively even spraying over the area covered by the sprinkler head. The total area covered depends on the deflector used and the rate of flow of fire retardant through the activated sprinkler.

In other aspects, it is contemplated that the device may have an optional tamper-resistant closure mechanism and, optionally, a colored position indicator. Also, since the ability to shut off the flow of fire retardant is local, this does not require disabling other fire sprinklers or the fire retardant supply to the general sprinkler system.

Figure 1A:
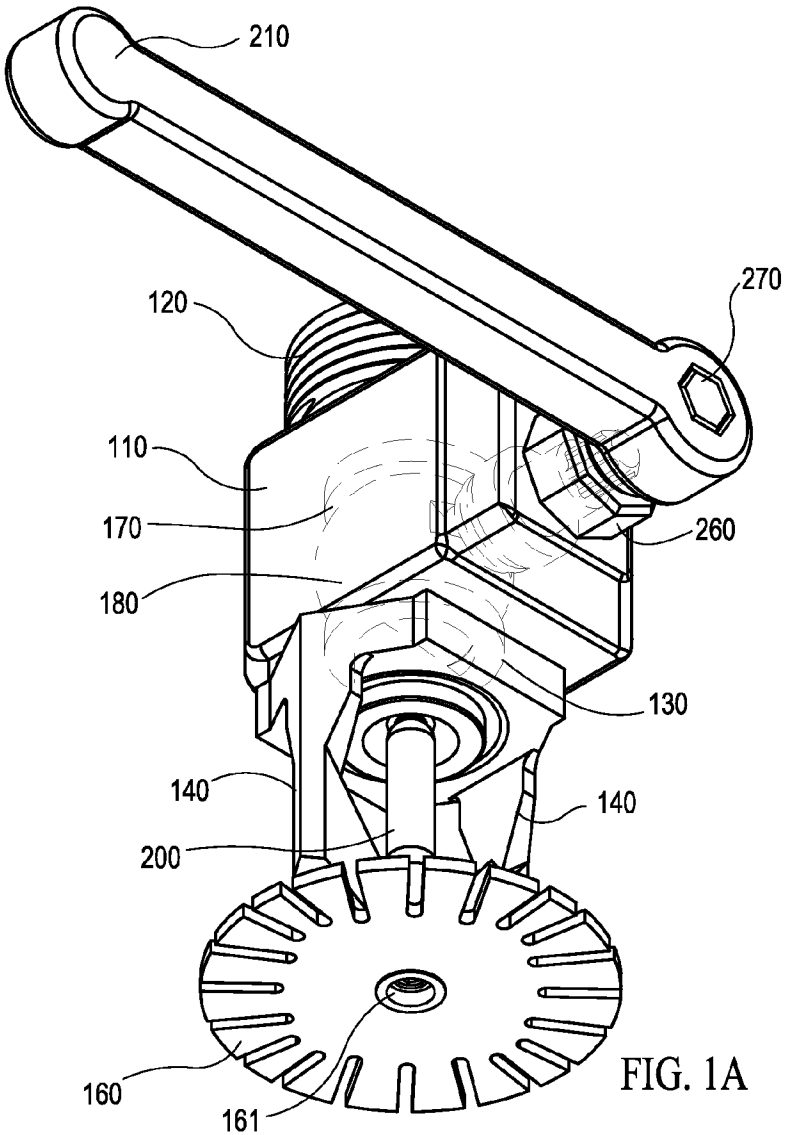

FIG. 1*a* is a perspective view from above showing the sprinkler housing 110, externally threaded nozzle 120, upper annulus 130, support arms 140, lower annulus 150, deflector shield 160, upper ball seal 170, ball 180, lower ball seal 190, heat-sensitive rod 200, inner seal 250, compression nut 260 and cutoff wrench 210.

FIG. 1*b* is a straight side view showing externally threaded nozzle 120, sprinkler housing 110, upper annulus 130, support arm 140, bracing point 230, deflector shield 230, upper ball seal 270, ball 180, stud 240, inner seal 250, compression nut 260 and cutoff wrench 210.

Figure 1C:
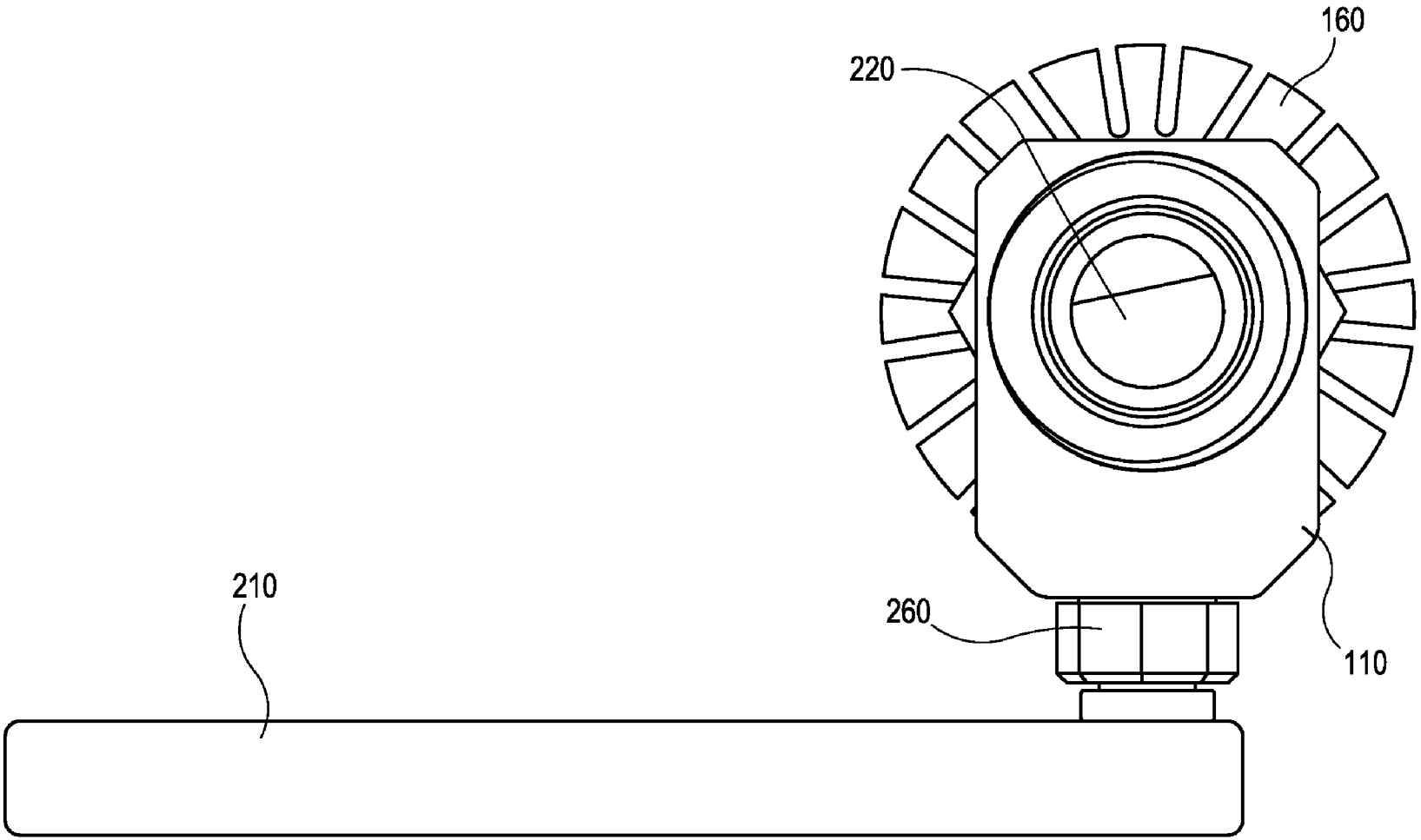

FIG. 1*c* is a straight top view evidencing activation plug 220 showing through threaded nozzle 120, sprinkler housing 120, deflector shield 160, inner seal 250, compression nut 260 and cutoff wrench 210.

Nozzle

Common threading on the nozzle provides attachment means to ordinary feeding pipes for supplying fire retardant, such as water.

Housing

The housing is modified only to provide access for the closure stem to the built-in cutoff valve.

Connection

The connection of the housing to the deflector. The connection does not impair proper deflection and dispersal of fire retardant.

Deflector.

The deflector helps disperse fire retardant evenly over the sprinkler's area of effect.

Indentation in the proximal end of the bracing point.

This indentation provides a seating point to brace the heat-sensitive rod in place.

Cutoff Valve Plug.

Once the sprinkler is activated, the heat-sensitive rod deforms or dissolves, and the activation plug is released from the hollow of the ball valve. Water or other fire retardant flows freely through the opening. On turning the cutoff valve, the ball valve plug rotates until the hole through the ball is perpendicular to the alignment of the sprinkler flow, and stops the flow of water.

Space to Rearm the Sprinkler.

The space indicated shows that the cutoff valve has sufficient play to allow a new primary sprinkler plug and heat-sensitive rod to be inserted to rearm the sprinkler.

Cutoff Valve Assembly.

The rotatable ball shall be seated in the center of the sprinkler housing and is perforated with a single circular aperture. When parallel to the flow direction through the sprinkler, the valve allows water or other retardant to flow. When turned to a perpendicular angle, the valve will stop such flow. On the side of the ball nearest the threaded nozzle, a valve seal ring shall be placed against the ball. A second valve seal ring shall be placed on the opposite side of the ball, nearest the upper annulus of the lower body assembly.

Cutoff Valve Closure Stem.

The ball contains an indention on its side to be engaged by the stud component of the closure stem assembly. In a preferred embodiment, the indention will take a rectangular shape, with curved ends of the rectangle tracking the slope of the edges of the ball. The opposite end of the stud will similarly engage with the socket. A preferred embodiment of such engagement is a male Torx end of the stud and female Torx end of the socket. Together, the stud/socket component shall extend through each of the inner seal ring and the compression nut. The compression nut itself shall be disposed within a round aperture in the side of the sprinkler housing, providing access to the ball valve assembly within. The distal end of the socket shall then protrude through the compression nut, where it shall be accessible for manual turning by one of the methods described herein.

Seating for the Cutoff Valve Tool.

This can take a variety of forms. If tamper-resistance is not needed, a simple hexagonal arrangement can be used such that the cutoff valve can be opened or closed with a hexagonal socket wrench. Similar configurations could be used allowing rotation with another type of wrench, allen wrench or screwdriver. In another example, an extended handle could be permanently attached to the closure stem allowing the cutoff valve to be opened or closed without any type of free-standing tool.

When tamper-resistance is beneficial, such as in a dormitory setting, different seatings are used. For example, the socket head can be milled to any nonstandard shape and mated with an identically nonstandard hand tool (e.g. nonstandard socket wrench), which hand tools would then be made available only to authorized personnel. Similarly, the extended head of the socket could be of standard shape, but be sheathed such that a standard socket wrench could not be used to engage the socket.

Figure 2:
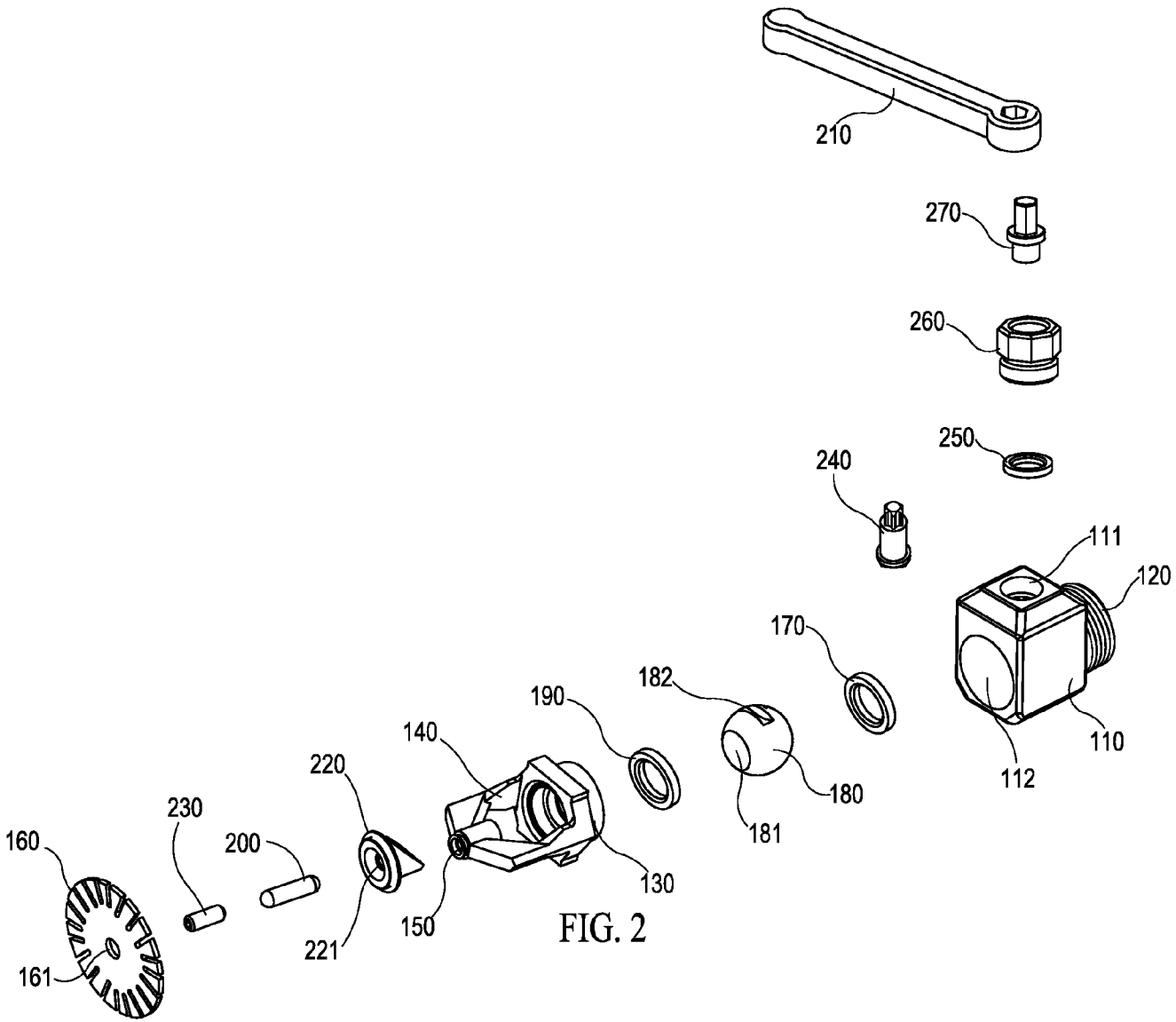
FIG. 2 is a graphical representation of an exploded view of all parts comprising the invention.

Referring now to FIG. 2, FIG. 2 is a graphical representation of an exploded view of one embodiment of the fire sprinkler beginning with deflector shield 160 on the left, then bracing point 230, heat-resistant rod 200, activation plug 220, lower annulus 150, support arms 140, upper annulus 130, lower ball seal 190, ball 180, upper ball seal 170, sprinkler housing 10, threaded nozzle 120, stud 240, inner seal 250, compression nut 260, socket 270 and cutoff wrench 210.

Figure 3A:
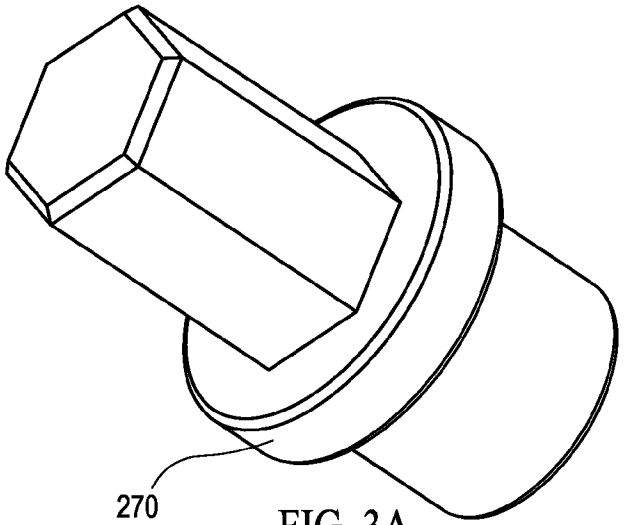
FIGS. 3*a-b* are graphical representations of one embodiment of the socket component of the closure stem, viewed from different perspectives.
Figure 3B:
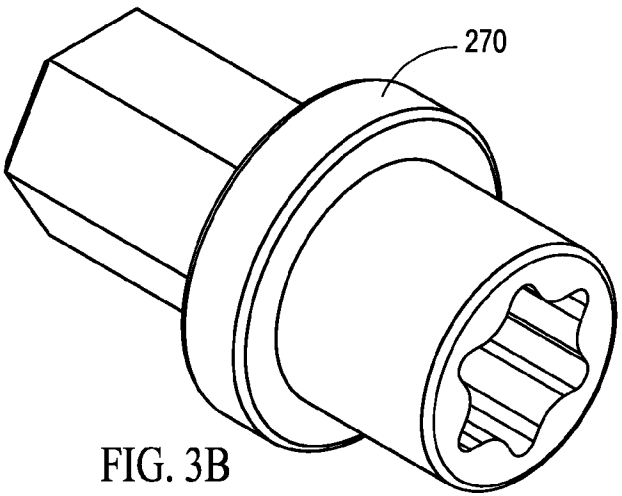

FIGS. 3*a-b* are graphical representations of the socket 270, viewed from different perspectives. FIG. 3*a* shows the distal end of socket 270 with a male hexagonal head for engagement with cutoff wrench 210 (not shown). FIG. 3*b* shows the proximal end of socket 270 with a female Torx end for engagement with stud 240 (not shown).

Figure 4:
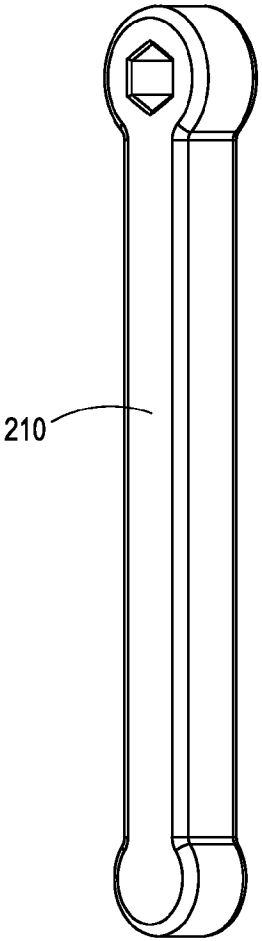
FIG. 4 is a graphical representation of one embodiment of a hand tool for engaging the closure stem socket, in this instance a standard hexagonal socket wrench.

FIG. 4 is a graphical representation of one embodiment of cutoff wrench 210 for engaging the closure stem socket 270 (not shown), in this instance a standard hexagonal socket wrench.

Figure 5B:
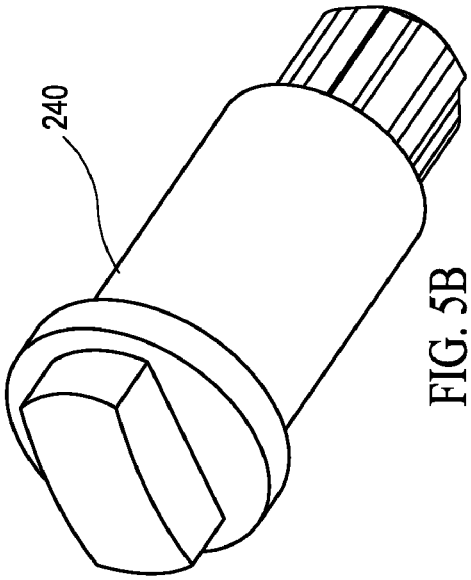
FIGS. 5*a-c* are a series of graphical representations of one embodiment the stud component of the closure stem.
Figure 5C:
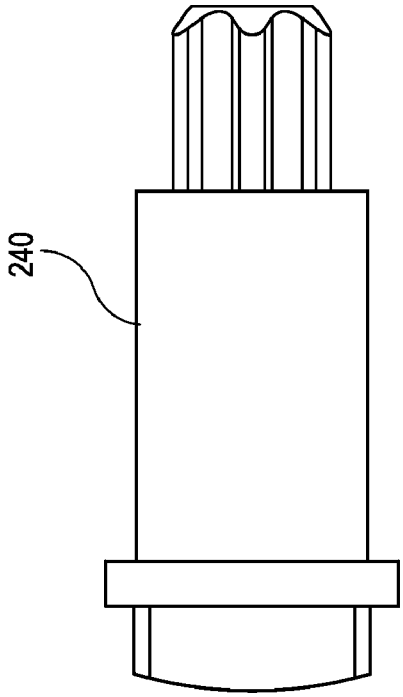
Figure 5A:
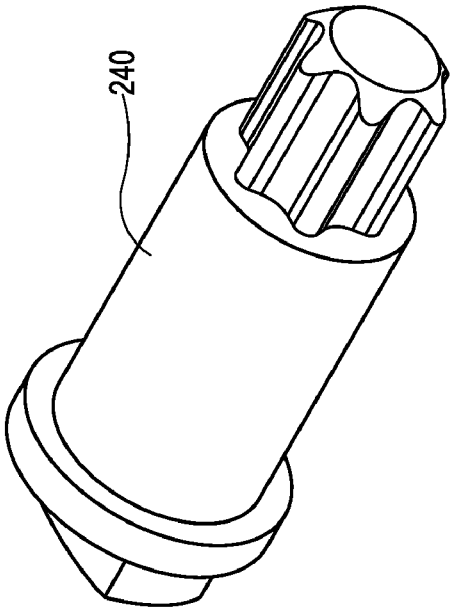

FIGS. 5*a-c* are a series of graphical representations of one embodiment stud 240. FIG. 5*a* shows the distal end of stud 240 as a male Torx configuration for engagement with socket 270 (not shown). FIG. 5*b* shows the proximal end of stud 240 as a male rectangle with rounded ends for engagement with ball 180 (not shown). FIG. 5*c* shows a straight side view of stud 240.

Figure 6B:
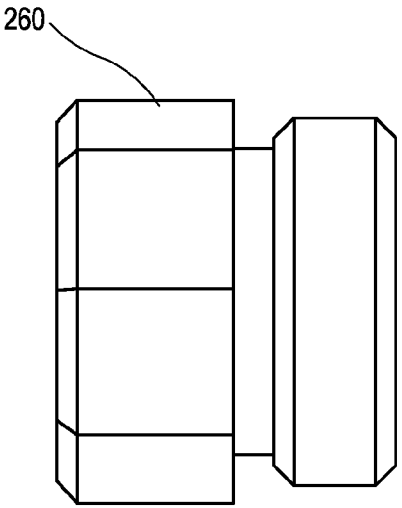
FIGS. 6*a-c* are a series of graphical representations of the compression nut component of the closure stem.
Figure 6C:
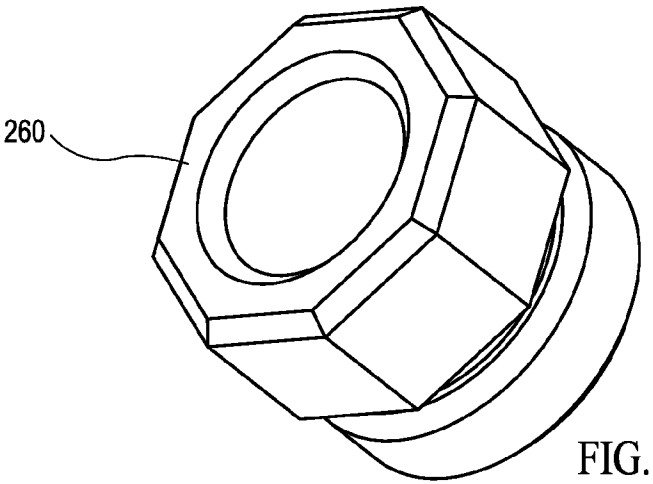
Figure 6A:
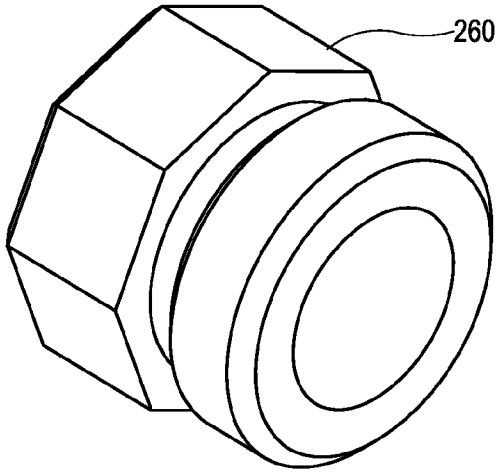

FIGS. 6*a-e* are a series of graphical representations of the compression nut 260. FIG. 6*a* is a view of the proximate end of compression nut 260, which end protrudes through the side aperture in sprinkler housing 110 (not shown). FIG. 6*b* is a straight side view of compression nut 260. FIG. 6*c* is a view of the distal end of compression nut 6*c*, through which socket 270 (not shown) would protrude.

Figure 7B:
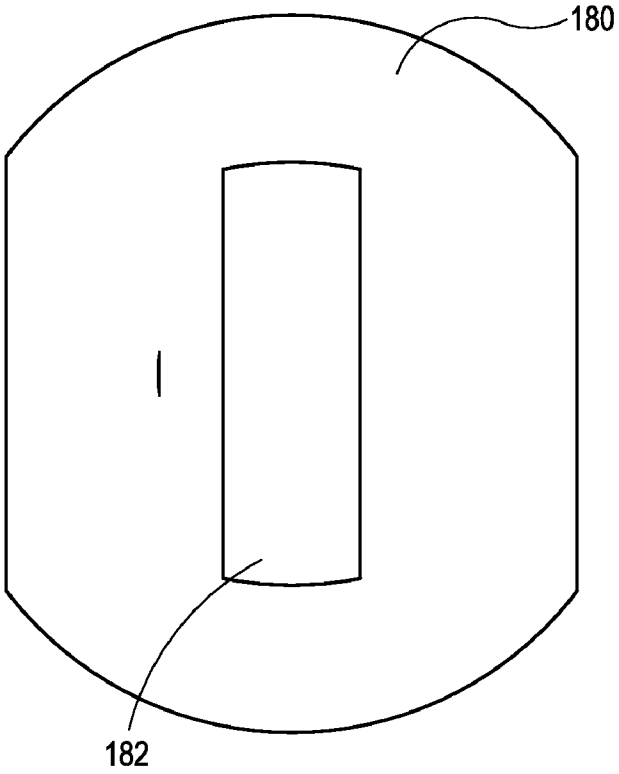
FIGS. 7*a-b* are graphical representations of the ball component of the ball joint.
Figure 7A:
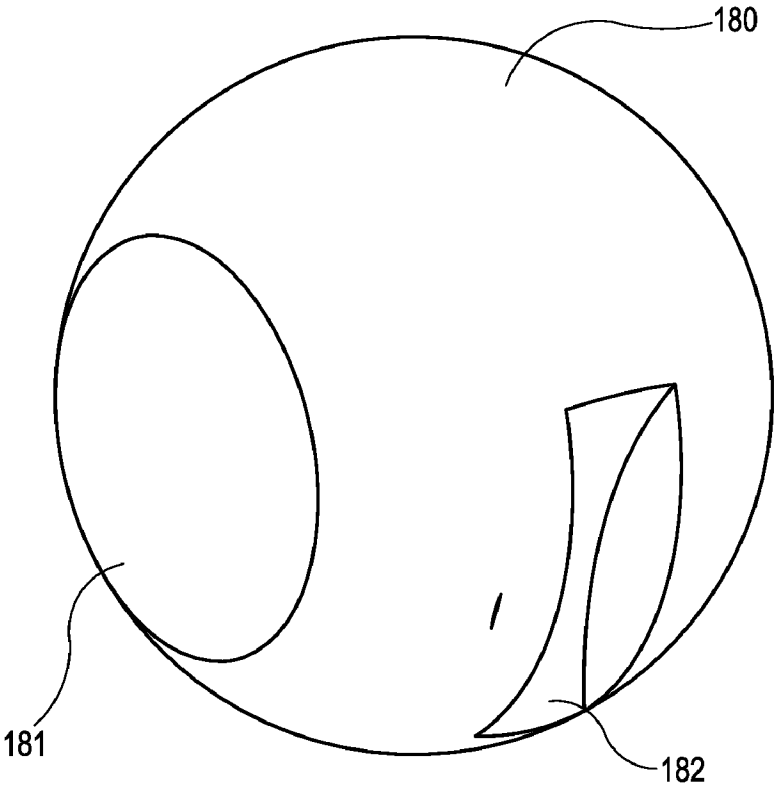

FIGS. 7*a-b* are graphical representation of the ball component of ball 180. FIG. 7*a* is a an upper perspective view evidencing intra-ball aperture 181 and indentation 182, the latter to be engaged with the proximate end of stud 240 (not shown). FIG. 7*b* is a straight side view also evidencing indentation 182.

Figure 8B:
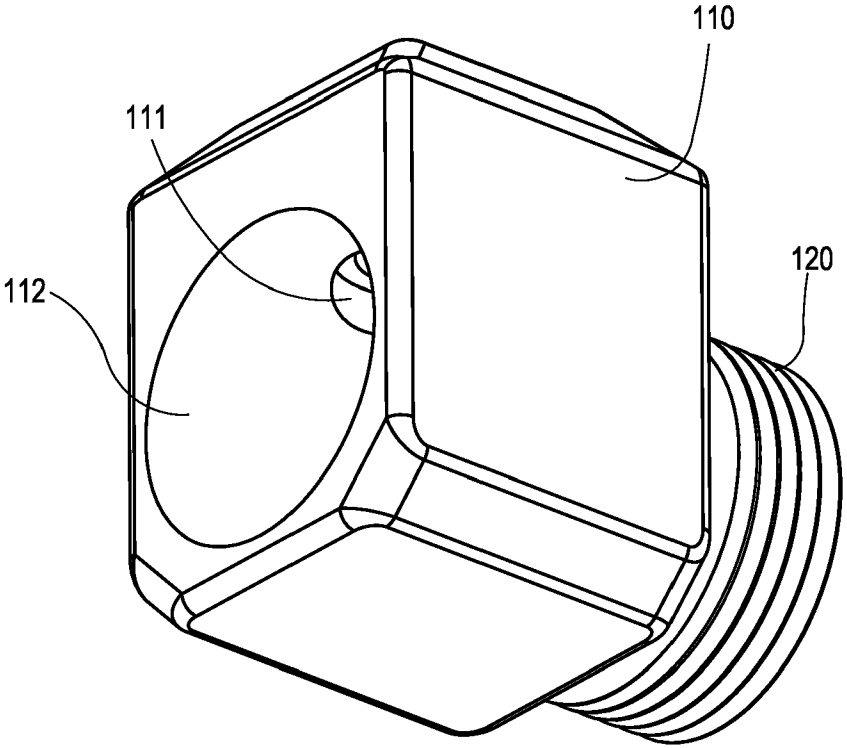
FIGS. 8*a-c* are a series of graphical representations of the sprinkler housing viewed from various perspectives.
Figure 8A:
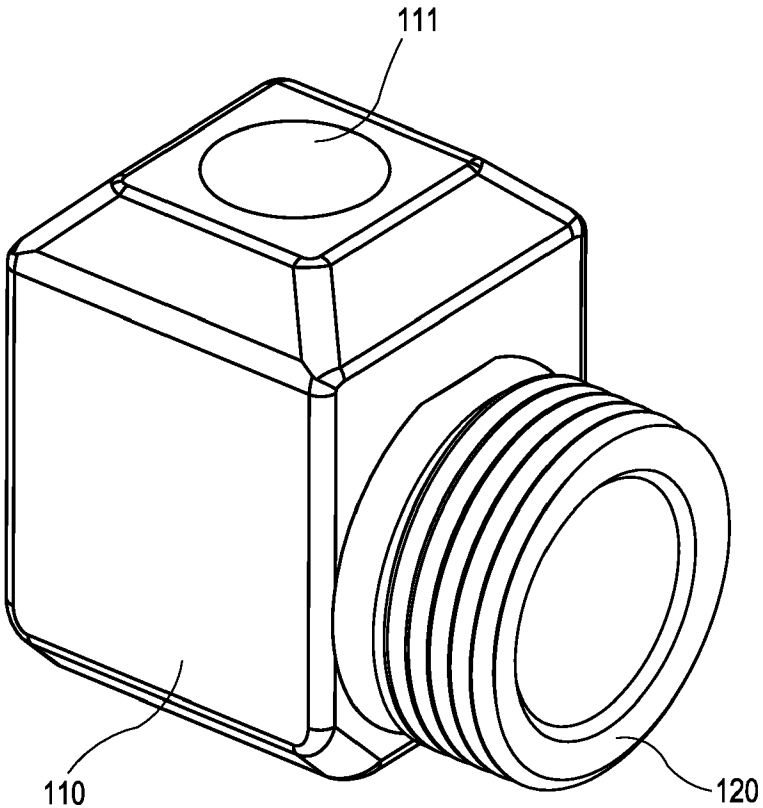
Figure 8C:
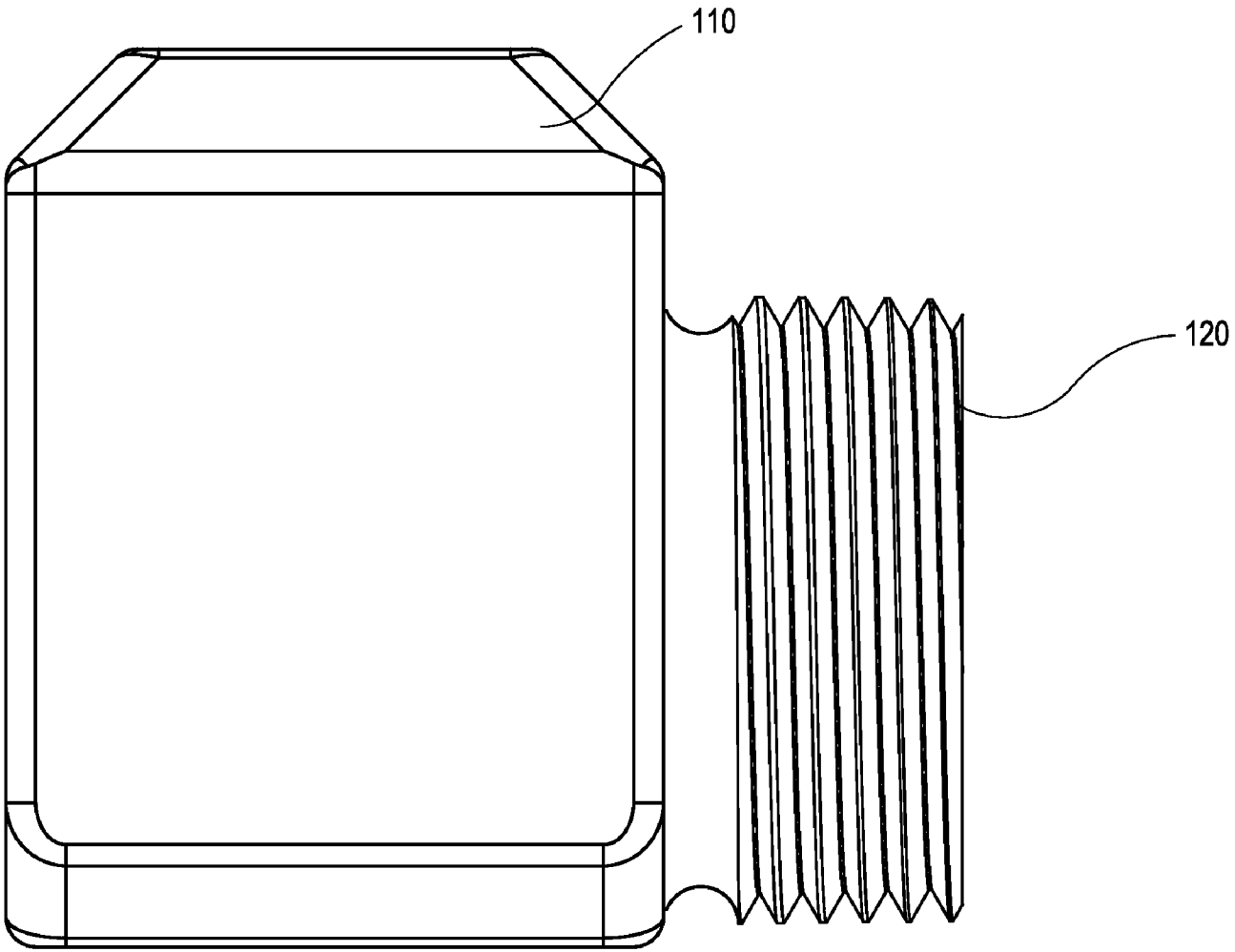

FIGS. 8*a-c* are a series of graphical representations of sprinkler 110 housing viewed from various perspectives. FIG. 8*a* shows an upper front view evidencing threaded connector 120 and compression nut aperture 111. FIG. 8*b* shows a lower back view showing ball valve aperture 112. FIG. 8*c* shows a straight side view.

Figure 9B:
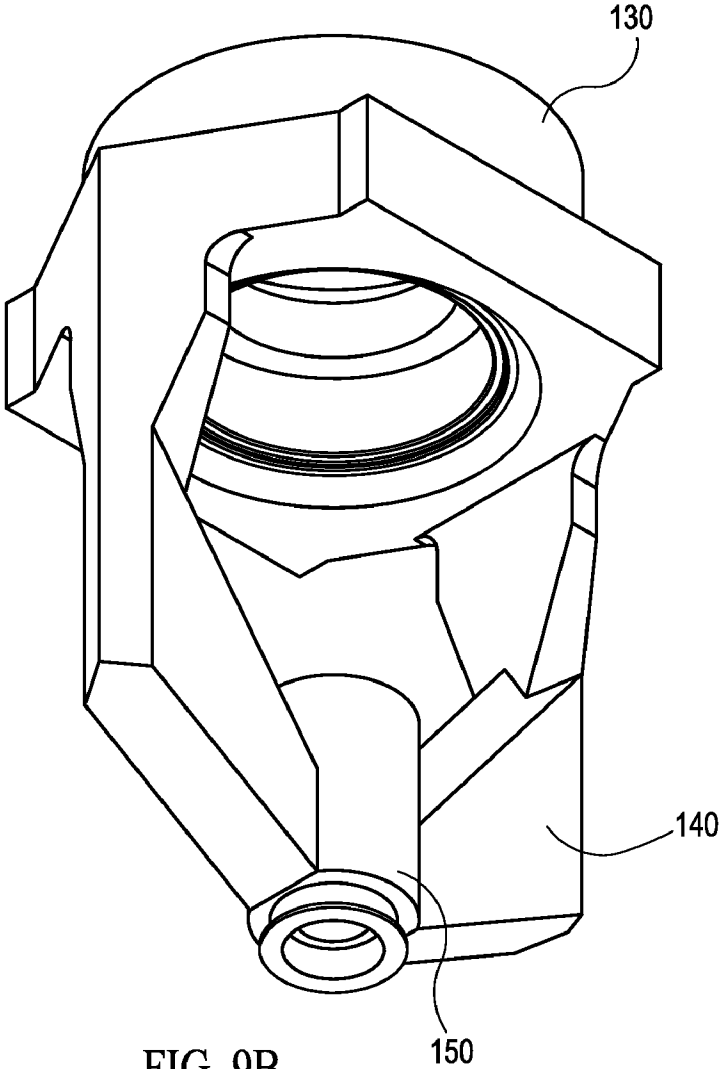
FIGS. 9*a-d* are line drawings of various views of the lower body of the sprinkler—upper annulus, arms, lower annulus—from different perspectives.
Figure 9A:
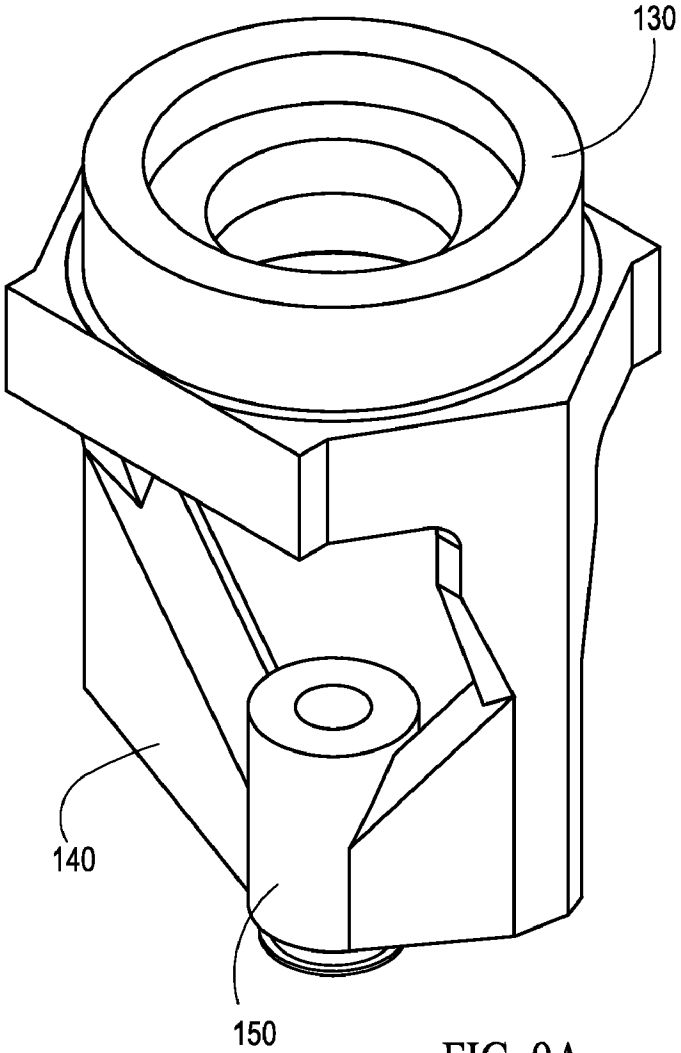
Figure 9D:
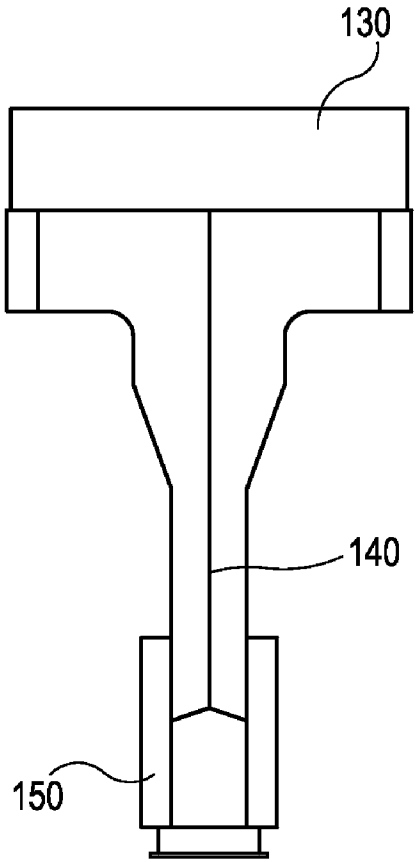
Figure 9C:
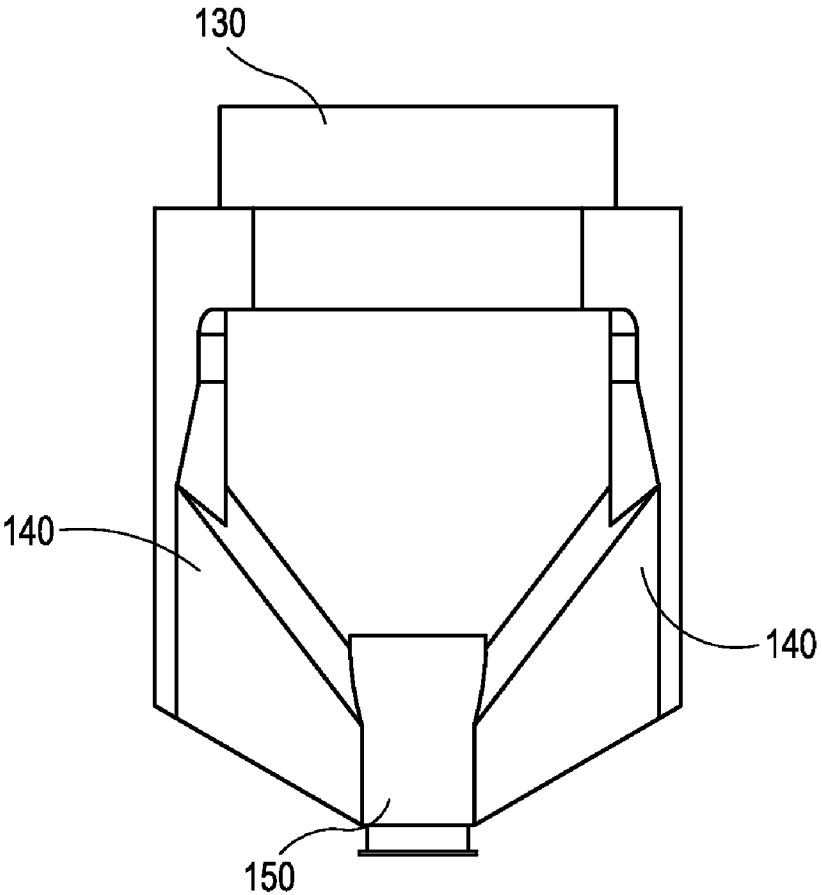

FIG. 9*a-d* are graphic representations of various views of the lower body of the sprinkler—upper annulus 130, support arms 140, lower annulus 150—from different perspectives. FIG. 9*a* show a top perspective view. FIG. 9*b* is a bottom view. FIG. 9*c* is a front view. FIG. 9*d* is side view.

Figure 10B:
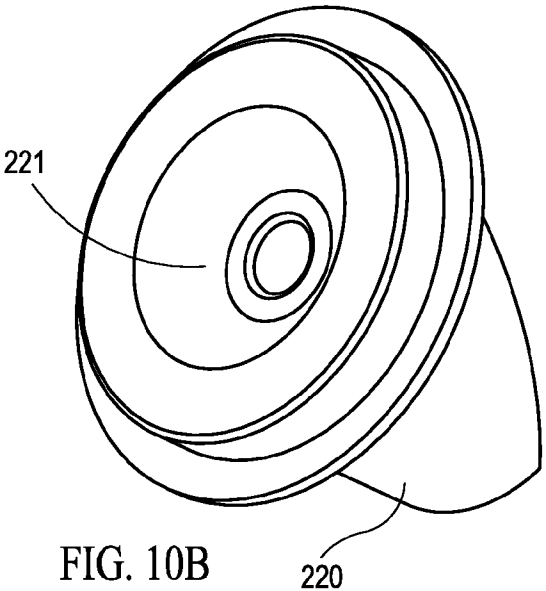
FIGS. 10*a-c* are line drawings of the activation plug, viewed from various perspectives.
Figure 10C:
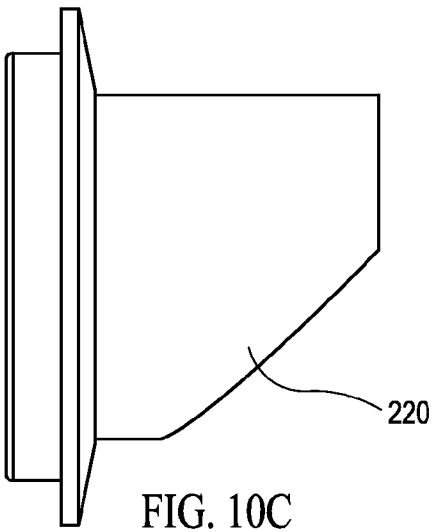
Figure 10A:
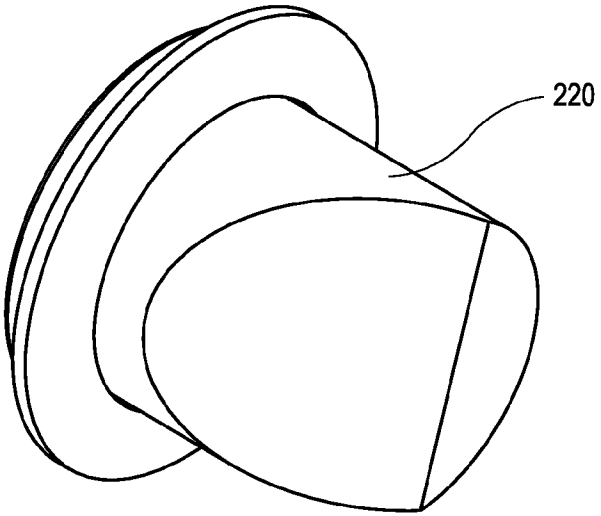

FIG. 10*a-c* are line drawings of the activation plug 220. FIG. 10*a* shows a top view evidencing the proximate end of plug 220 which will be inserted through lower ball seal 190 (not shown) and into the intra-ball aperture 181 (not shown). FIG. 10*b* shows a bottom view of the distal end of plug 220 evidencing plug cup 221, which will engage with the proximate tip of heat-sensitive rod 200 (not shown). FIG. 10*c* is a straight side view.

Figure 11:
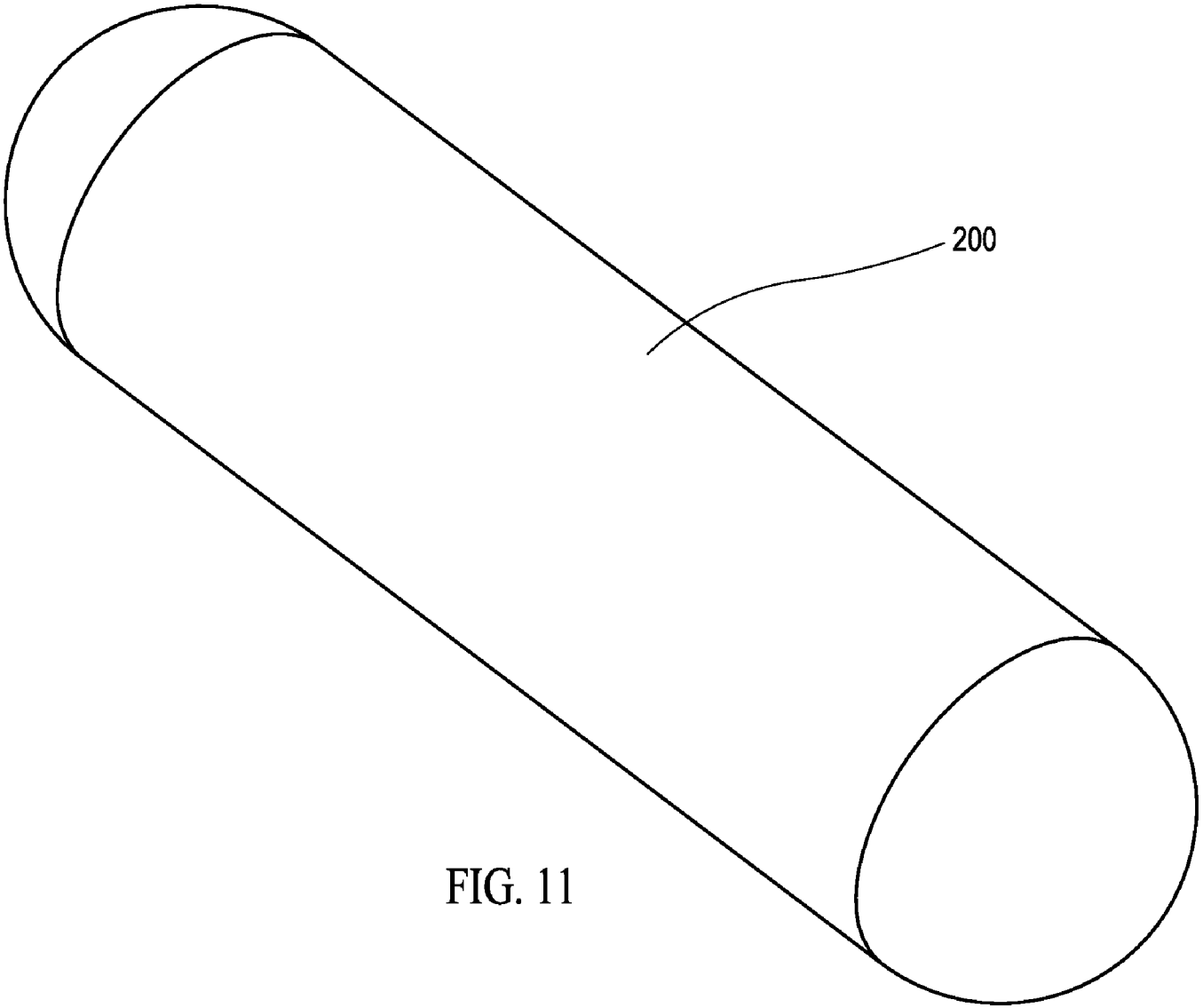
FIG. 11 is a graphic representation of the heat-sensitive frangible rod.

FIG. 11 is a graphic representation of the heat-sensitive frangible rod 200, showing a top perspective view.

Figure 12B:
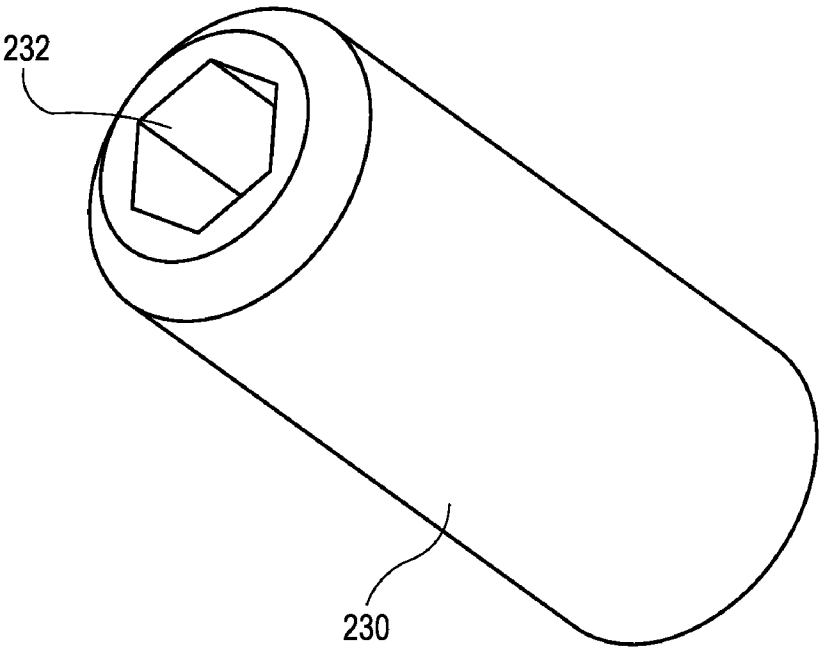
FIGS. 12*a-b* are graphic representations of the bracing point from different perspectives.
Figure 12A:
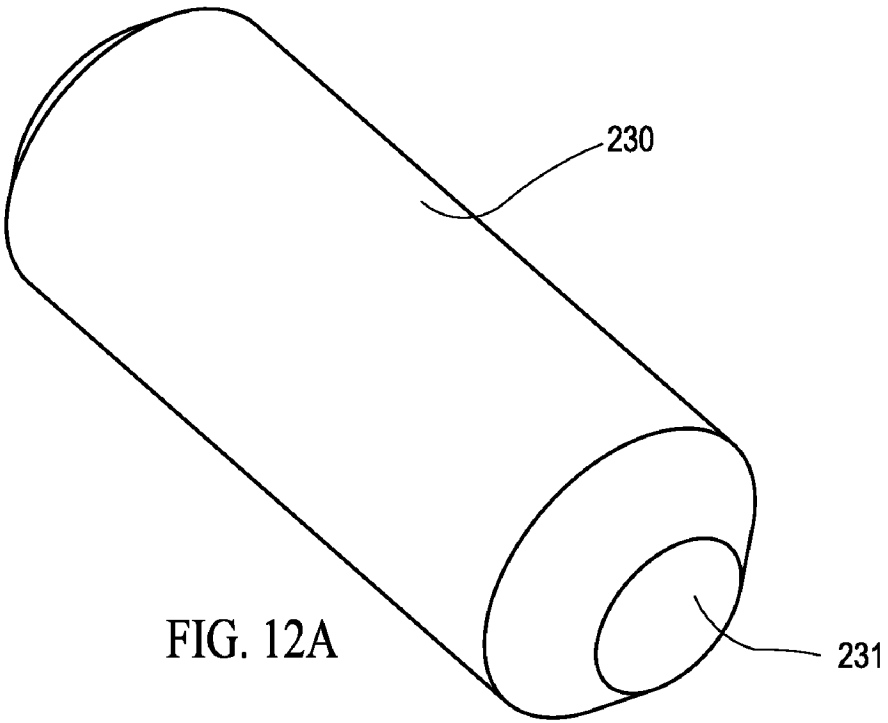

FIGS. 12*a-b* are graphic representations of bracing point 230. FIG. 12*a* shows a top perspective view evidencing the bracing point cup 231 on the proximate end of bracing point 230, which is to cradle the distal tip of heat-sensitive frangible rod 200 (not shown). FIG. 12*b* shows a bottom perspective view evidencing screw hole 232, to match with center hole 161 in deflector shield 160 (not shown).

Figure 13B:
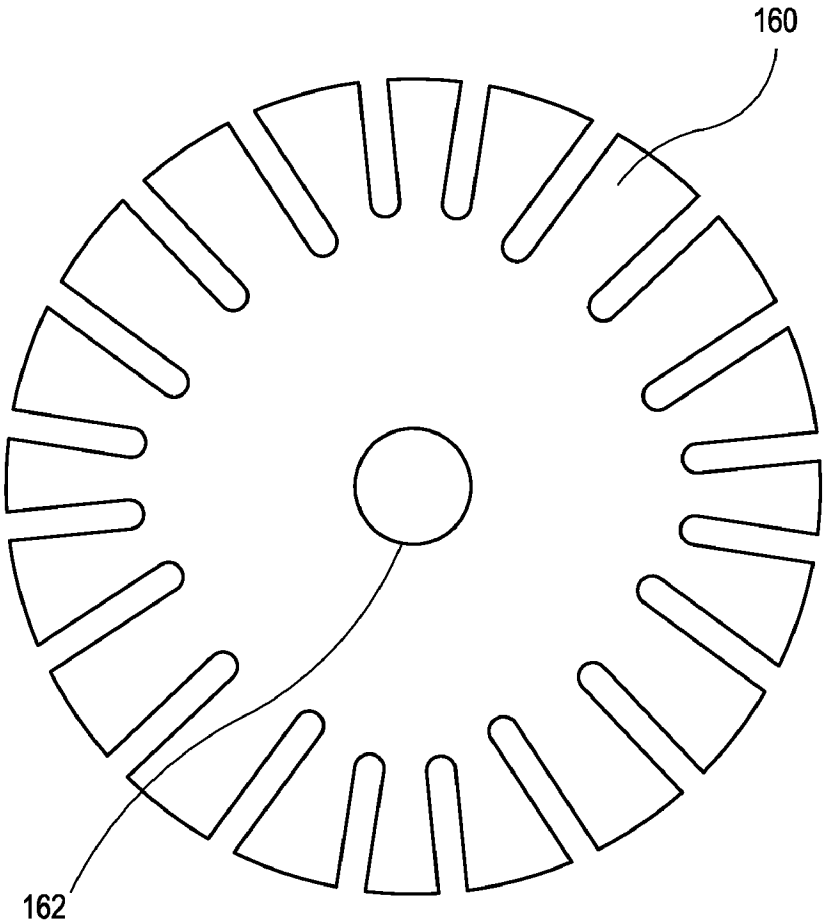
FIGS. 13*a-b* are a series of graphic representations of an embodiment of the deflector shield.
Figure 13A:
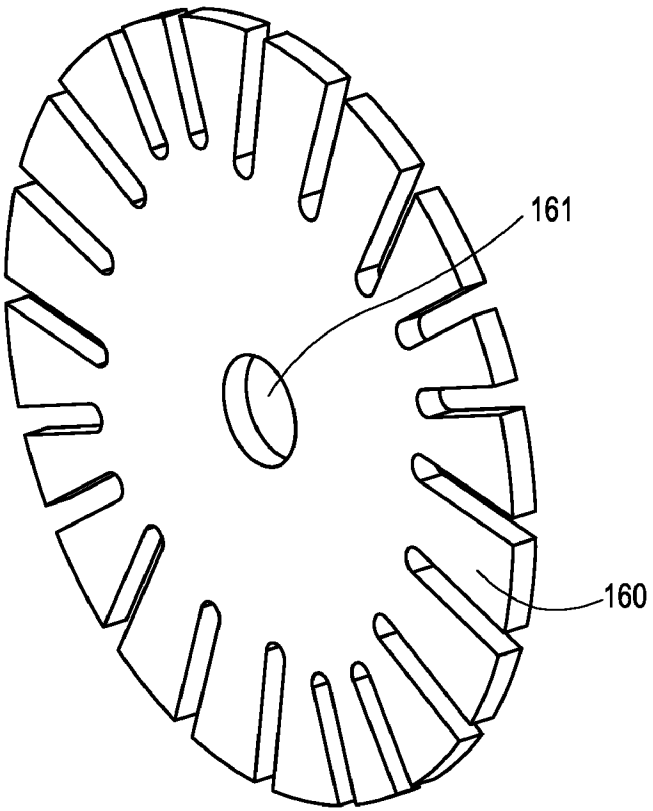

FIGS. 13*a-b* are a series of graphic representations of an embodiment of deflector shield 160. FIG. 13*a* is a top perspective view evidencing center hole 161. FIG. 13*b* is a straight bottom view with screw 162 visible through center hole 161, such screw to engage screw hole 232 in bracing point 230 (not shown).

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims.

What is claimed is:

1. A fire sprinkler with a built-in cutoff valve, comprising: a sprinkler housing comprising an externally threaded round sprinkler nozzle disposed along a central axis and allowing fire retardant to flow into said housing, said sprinkler nozzle having a distal end for connecting to a supply pipe and a proximal end overlapping a ball valve capable of being manually set to allow or disallow the flow of retardant, such ball valve comprised of a rotatable ball set between an upper ball seal and a lower ball seal and connected to a closure stem, such upper ball seal disposed within the proximal end of the sprinkler nozzle and such lower ball seal disposed within the upper annulus of a lower body unit comprised of such upper annulus attached to a pair of support arms, wherein each support arm extends from the upper annulus and terminates at a lower annulus that is disposed along the central axis, such lower body unit further comprising an activation plug disposed within each of the upper annulus, lower ball seal and the ball itself, said activation plug braced against the proximal end of a heat-sensitive rod disposed along the central axis between said support arms, the distal end of such heat-sensitive rod seated in the proximal end of a bracing point, the distal end of such bracing point attached to the center of a circular deflector shield, and said support annulus attached to the center of said deflector shield.

2. The fire sprinkler of claim 1, wherein an aperture is drilled into the side of said sprinkler housing through which the closure stem for manually engaging or disengaging the ball valve may be fitted, such closure stem comprising a socket comprised of a proximate end allowing engagement with a wrench or other device capable of turning such socket, and a distal end allowing engagement with a stud, further comprising a hollow compression nut comprising a proximate end fitted flush against the exterior of the housing around said aperture and a smaller circular distal end fitted flush into the aperture, such distal end contacting an inner seal ring of the same gauge and circumference as the distal end of the compression nut, wherein the distal end of the socket extends through the interior of said compression seal, where said distal end of the socket engages the proximate end of a stud disposed within the compression seal and inner seal and compression seal, further comprising wherein the distal end of such stud engages an indentation in the side of the ball, allowing an operator to rotatably open and close the ball valve.

3. The fire sprinkler of claim 1, where the externally threaded sprinkler nozzle is fitted for standard fire sprinkler fitting sizes.

4. The fire sprinkler of claim 1, where the sprinkler contains a wrench fitting to allow easier connection and disconnection from a sprinkler supply.

5. The fire sprinkler of claim 1, where the sprinkler contains a standard sealed fire sprinkler activation plug that stops the flow of the fire retardant from the sprinkler supply pipe through the sprinkler.

6. The fire sprinkler of claim 1, where the heat-sensitive rod is a frangible support rod that (1) holds the plug in place, (2) is thermodynamically responsive to at least one of heat, smoke, infrared radiation and ultraviolet radiation emitted by a heat source, and (3) deforms or dissolves when heated to its tolerance temperature.

7. The fire sprinkler of claim 1, where the deflector shield disperses water or other fire retardant in a reasonably uniform shower pattern to create more effective fire suppression.

8. The fire sprinkler of claim 1, wherein the sprinkler is installed as a pendent sprinkler below the supply pipe.

9. The fire sprinkler of claim 1, wherein the sprinkler assembly is of a sufficiently short length to allow the sprinkler to fit into a standard sprinkler head recession space.

10. The fire sprinkler of claim 1, wherein the sprinkler is installed as one of a vertical sprinkler above the supply pipe, a lateral sprinkler, or any other angle to the supply pipe necessitated by conditions.

11. The fire sprinkler of claim 1, wherein the ball valve forms water-tight or gas-tight seal against sprinkler supply pipe pressure.

12. The fire sprinkler of claim 1, wherein the activation plug is inserted into the intra-ball aperture, thereby disallowing any attempt to manually close the ball valve prior to heat-induced activation of the sprinkler.

13. The fire sprinkler of claim 1, wherein the ball valve is replaced with one of a gate valve, butterfly valve, annular valve, diaphragm valve, pinched valve, needle valve or other type of plumbing valve known in the art.

14. The fire sprinkler of claim 2, wherein the socket is configured to allow for engagement and turning with a Phillips-head screwdriver, flat-head screwdriver, allen wrench, crescent wrench, pliers, hex wrench, or other standard hand tool.

15. The fire sprinkler of claim 2, wherein the socket is permanently attached to a rod or handle allowing for engagement or disengagement of the ball valve without the use of any standard or nonstandard hand tool.

16. The fire sprinkler of claim 2, wherein the socket has a custom tamper-resistant screw head access and is not accessible to any standard hand tool.

17. The fire sprinkler of claim 2, wherein the socket has a standard head protected by a metal sheath, making the socket head inaccessible to any standard hand tool, for tamper resistance.

18. The fire sprinkler of claim 2, wherein the socket is painted to facilitate ready identification of a closed or open configuration of the ball valve.

19. The fire sprinkler of claim 2, wherein the socket is fluorescent and reflective red.

* * * * *